US007473133B1

(12) United States Patent
Zhang

(10) Patent No.: US 7,473,133 B1
(45) Date of Patent: Jan. 6, 2009

(54) ELECTRICAL CONNECTOR

(75) Inventor: George(Huanyi) Zhang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/825,266

(22) Filed: Jul. 5, 2007

(51) Int. Cl.
*H01R 13/648* (2006.01)

(52) U.S. Cl. ..... 439/607; 439/79

(58) Field of Classification Search ..... 439/79, 439/541.5, 607
See application file for complete search history.

(56) References Cited

U.S. PATENT DOCUMENTS 4,806,109 A * 2/1989 Manabe et al. ..... 439/108
5,055,069 A * 10/1991 Townsend et al. ..... 439/608
5,167,531 A * 12/1992 Broschard et al. ..... 439/541.5
5,403,206 A * 4/1995 McNamara et al. ..... 439/608
6,540,563 B1 * 4/2003 Hu et al. ..... 439/676
6,561,829 B2 * 5/2003 Maeda et al. ..... 439/247
6,699,070 B1 * 3/2004 Wu ..... 439/574
6,758,685 B1 7/2004 Huang et al.
6,767,224 B2 * 7/2004 Wu ..... 439/79
6,948,980 B2 * 9/2005 Xiang et al. ..... 439/607
7,018,237 B2 * 3/2006 Zhan et al. ..... 439/607
7,052,321 B2 5/2006 Chang
7,063,545 B2 * 6/2006 Zu et al. ..... 439/79
7,114,975 B2 * 10/2006 Liao et al. ..... 439/326

FOREIGN PATENT DOCUMENTS

CN 2793964 Y 7/2006
CN 2865042 Y 1/2007

* cited by examiner

*Primary Examiner*—Thanh-Tam T Le
(74) *Attorney, Agent, or Firm*—Wei Te Chung

(57) ABSTRACT

An electrical connector (100) includes an insulative housing (2), a number of first and second contacts (31, 32) accommodated in the insulative housing and a conductive shell (5). The insulative housing includes first and second mating segments (25, 26) side by side arranged along a lateral direction perpendicular to a mating direction and divided by a partition wall (205), and a rear wall (24) extending downwardly from rear ends of the first and second mating segments and forming a division section to divide the rear wall into two parts corresponding to the first and second mating segments. The first and second contacts are received in the insulative housing with mating portions (30) thereof received in the first and second mating segments, and leg portions (34) bending downwardly to be located in the two parts of the rear wall. The conductive shell encloses the insulative housing and the contacts except the first and second mating segments and mating portions of the contacts. The conductive shell forms a solder foot (500) aligning with the division section of the rear wall of the insulative housing for being assembled to a printed circuit board.

15 Claims, 9 Drawing Sheets

ELECTRICAL CONNECTOR

BACKGROUND OF THE INVENTION

1. Field of the Invention

The present invention generally relates to an electrical connector, and more particularly to an electrical connector used for high-speed transmission.

2. Description of Related Art

Impedance match and EMI issue are two most important things for signal transmission of electrical connectors. Different kinds of ways are adopted by designers to adjust the impedance of contacts to proper value and improve the EMI effect. To adjust the impedance of contacts to proper value, designers usually adopt the way of changing the dielectric constant around the contacts. To improve the EMI effect, designers usually adopt a conductive shell to cover housing and contacts to depress EMI. These solutions are more important for connectors used in external circumstances. As disclosed by U.S. Pat. Nos. 7,052,321 and 6,758,685, conductive shells are adopted to enclose housings and contacts to improve EMI effect. Particularly, rear walls of the conductive shells each define a cutout at lower ends thereof to expose tail portions of the contacts to be soldered on corresponding PCBs. However, it is right the cutouts cause the leakage of noises which affects the EMI effect. It is desired to have an electrical connector with improved conductive shell to improve EMI effect. On the other hand, CN Patent Nos. 2865042 and 2793964 respectively disclose a housing forming a plurality of aligning slots on rear wall to align tail portions of contacts and adopting a spacer to aligning tail portion of contacts. These proposals mainly for how to align tail portions of contacts, and not mentioned impedance match problem. Therefore, how to control impedance to desired value is another problem needing to be resolved.

BRIEF SUMMARY OF THE INVENTION

Accordingly, an object of the present invention is to provide an electrical connector with improved conductive shell for improving EMI effect.

Another object of the present invention is to provide an electrical connector with desirable impedance match.

In order to achieve the above-mentioned object, an electrical connector in accordance with the present invention comprises an insulative housing comprising a front mating port extending along a mating direction and a front wall extending downwardly from the front mating port, a plurality of contacts accommodated in the insulative housing and a conductive shell. The front mating port of the insulative housing defines a plurality of receiving passages along the mating direction. The front wall is slotted with a plurality of slots extending along an up-to-down direction perpendicular to the mating direction. The contacts are received in the receiving passages and the slots of the insulative housing and each contact comprises a curved mating portion received in corresponding receiving passage and partially exposed beyond the receiving passage, a retention portion interferentially engaged with the receiving passage to retain the contact in the insulative housing, a leg portion bending downwardly from the retention portion to be mainly received in each of the slots of the insulative housing, and a tail portion formed at lower end of the leg portion and bending horizontally from the lower end of the leg portion. The leg portion has a larger width than other portion of the leg portion and is received in corresponding slot to achieve a certain dielectric constant for signal transmission. The conductive shell encloses the insulative housing and the contacts except the mating port and the contacting portions of the contacts.

In order to achieve the above-mentioned object, an electrical connector in accordance with the present invention comprises an insulative housing, a plurality of first and second contacts accommodated in the insulative housing and a conductive shell. The insulative housing comprises first and second mating segments side by side arranged along a lateral direction perpendicular to a mating direction and divided by a partition wall, and a rear wall extending downwardly from rear ends of the first and second mating segments and forming a division section to divide the rear wall into two parts corresponding to the first and second mating segments. The first and second contacts are received in the insulative housing with mating portions thereof received in the first and second mating segments, and leg portions bending downwardly to be located in the two parts of the rear wall. The conductive shell encloses the insulative housing and the contacts except the first and second mating segments and the mating portions of the contacts. The conductive shell forms a solder foot aligning with the division section of the rear wall of the insulative housing for being assembled to a printed circuit board.

Other objects, advantages and novel features of the invention will become more apparent from the following detailed description of the present embodiment when taken in conjunction with the accompanying drawings.

DETAILED DESCRIPTION OF THE INVENTION

Figure 1:
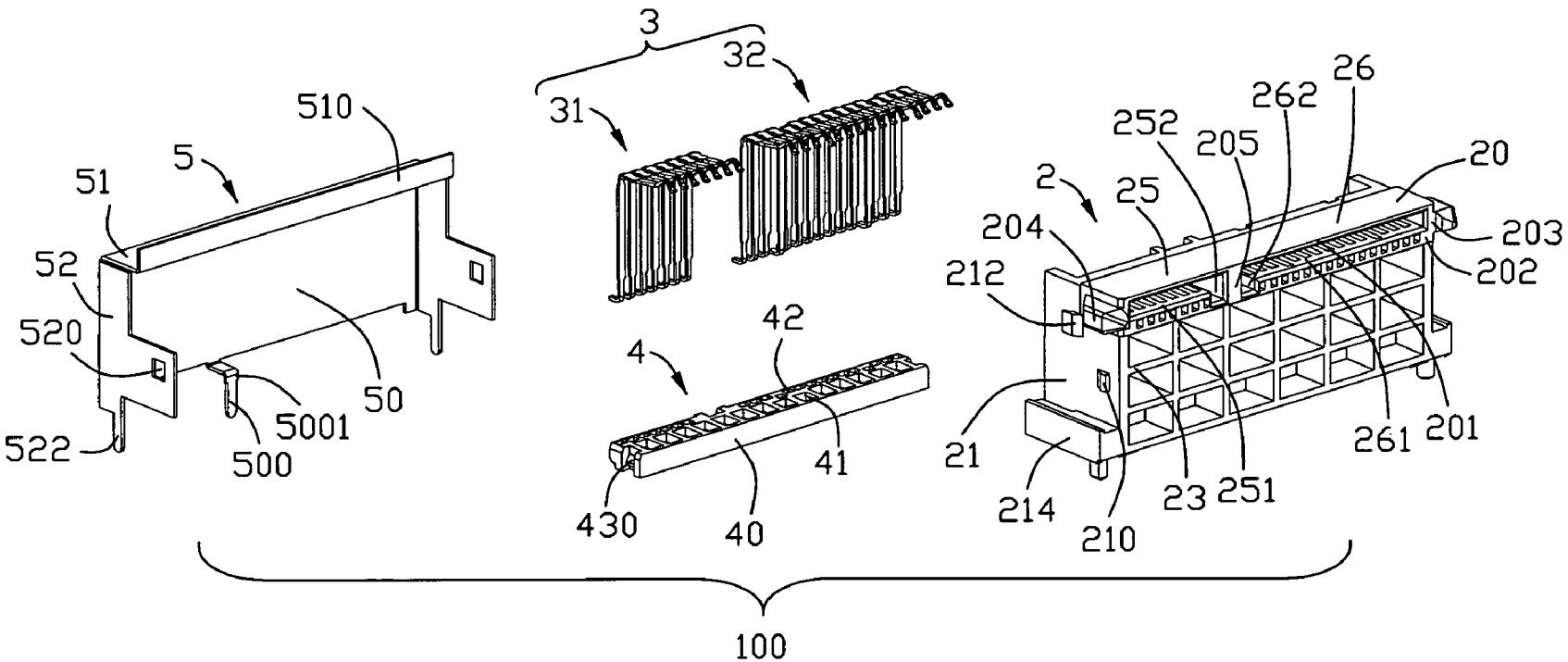
FIGS. 1-3 are exploded, perspective views of an electrical connector in accordance with the present invention and viewed from different aspects.

Reference will now be made to the drawing figures to describe the present invention in detail.

Figure 2:
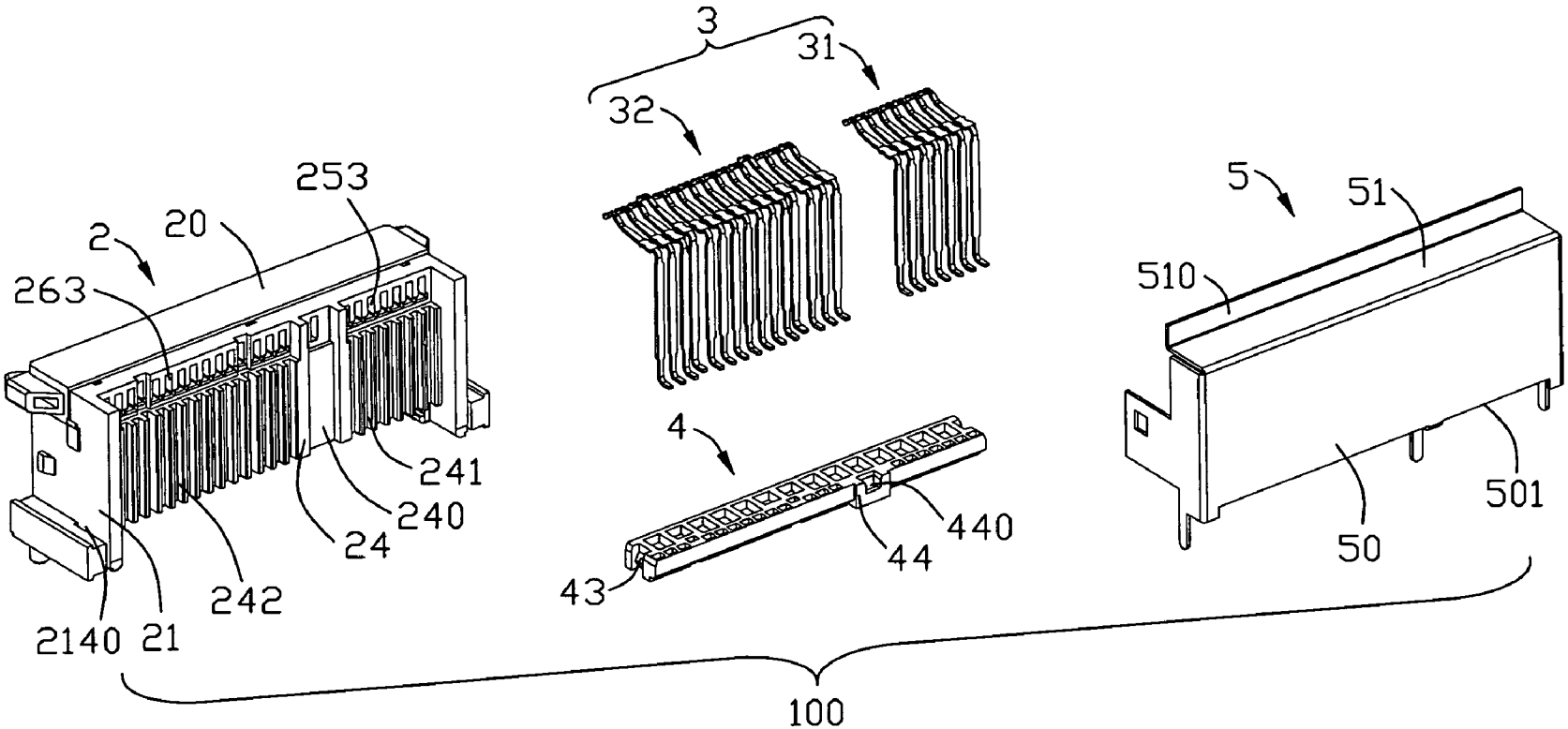
Figure 3:
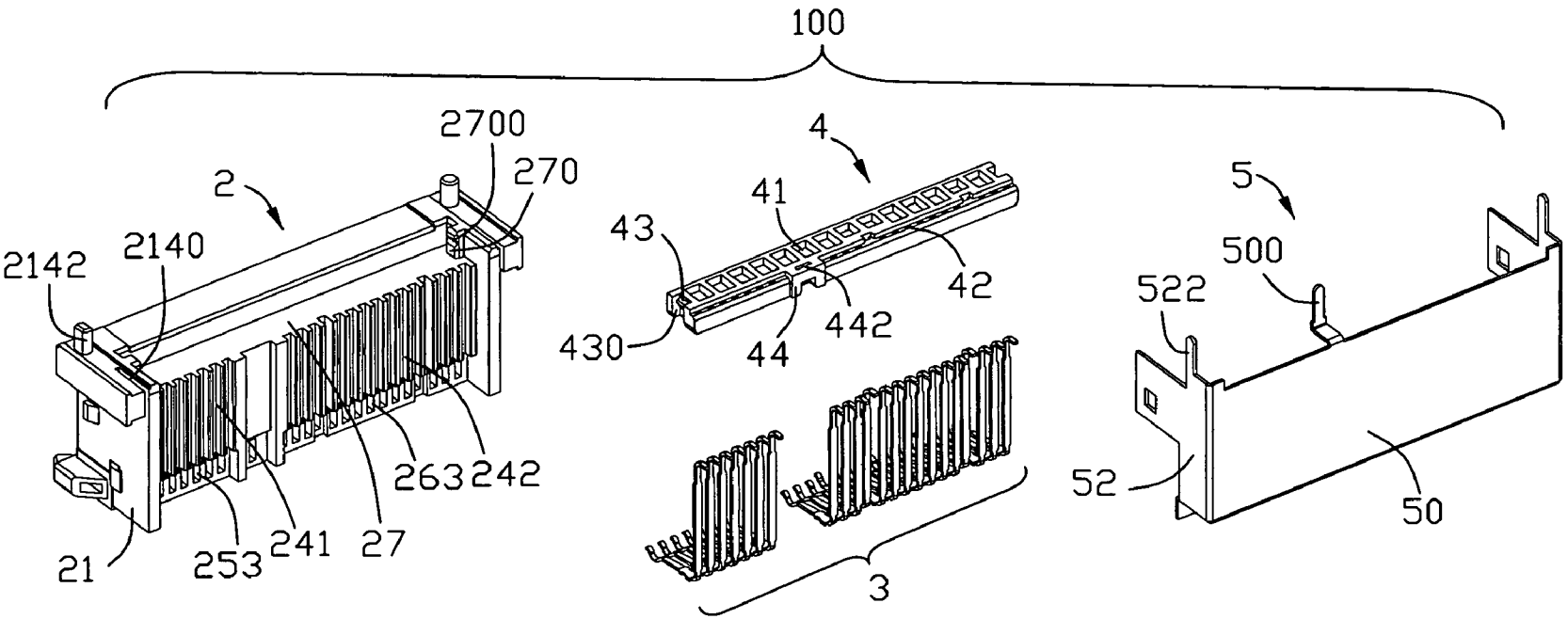

Please refer to FIGS. 1-3, an electrical connector 100 in accordance with the present invention comprises an insulative housing 2, a plurality of contacts 3 accommodated in the insulative housing 2, a spacer 4 assembled to the insulative housing 2 and aligning the contacts 3, and a conductive shell 5 assembled to the insulative housing 2 and the spacer 4 to shield the contacts 2.

Still to FIGS. 1-3, the insulative housing 2 comprises a mating port 20, a pair of L-shape sidewalls 21 extending downwardly and rearwardly from outmost edges of the mating port 20, a rear wall 24 formed between the pair of sidewalls 21 and connecting with the rear end of the mating port 20, and a front wall opposite to the back wall. The mating port 20 comprises an upper wall 201, a lower wall 202 opposite to the upper wall 201, and a pair of lateral walls 203 connecting with the upper and lower walls 201, 202. A pair of tapered guiding posts 204 are respectively formed with the lateral walls 203 for guiding the insertion of the complementary connector. A partition wall 205 is formed between the upper and lower walls 201, 202 to form dual first and second mating segments 25, 26 with different lateral dimensions. Each mating segment 25, 26 forms first and second blocks 251, 261 formed with the lower wall 202 to form L-shape first and second receiving spaces 252, 262. A plurality of first and second receiving passages 253, 263 protruding through corresponding blocks 251, 261 and communicating with corresponding receiving spaces 252, 262.

A plurality of strengthened stiffeners 23 are formed among the pair of sidewalls 21 and the front wall 24 in a crisscross fashion for enhancing the intensity of the insulative housing 2. Each sidewall 21 forms a clamp wedge 212 behind the guiding post 204 with a slit formed between the clamp wedge 212 and the sidewall 21. A wedged-shape latch protrusion 210 is formed below the guiding post 204 and adjacent to front surface of the sidewall 21. A step 214 is formed at lower end of the sidewall 21 and defines slit 2140 at rear portion thereof and downwardly extending to communicate with bottom surface of the insulative housing 2. A supporting post 2142 depends downwardly from bottom surface of the step 214 for polarization when mounting to a Printed Circuit Board (PCB). Particularly, the pair of supporting posts 2142 have different shapes. The rear wall 24 of the insulative housing 2 is slotted with a plurality of first and second slots 241, 242 corresponding to the first and second receiving passages 253, 263. The first and second slots 241, 242 are divided by a dividing section (not labeled) and a channel 240 is recessed forwardly from the dividing section to align with the partition wall 205 in lateral direction. Further, the insulative housing 2 is partially cutoff from bottom surface thereof to define an L-shape opening 27 communicating with the first and second slots 241, 242 and between the pair of sidewalls 21. A pair of blocking portions 270 is oppositely formed on the sidewalls 21 and exposed in the opening 27. Middle of each blocking portion 270 defines a wedged-shape cutout to form a lower wedged-shape latch hook 2700.

Figure 4:
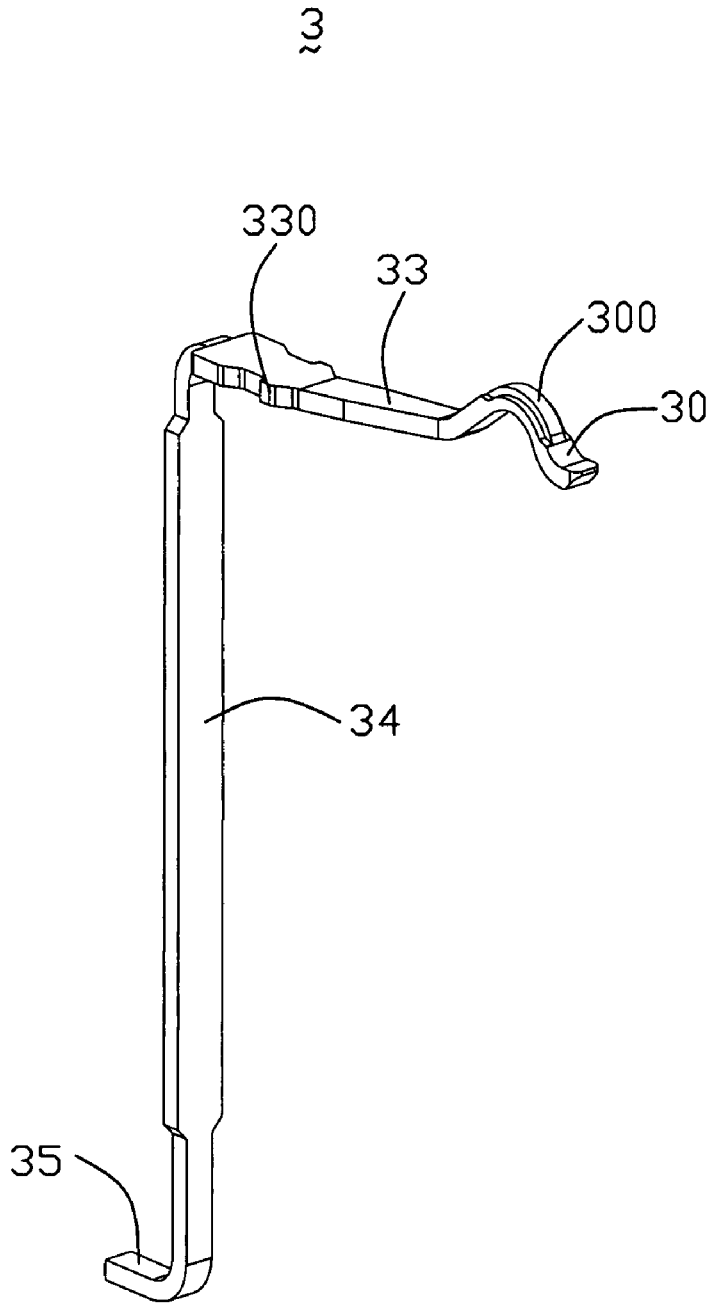
FIG. 4 is an enlarged view of a contact of the electrical connector.
Figure 5:
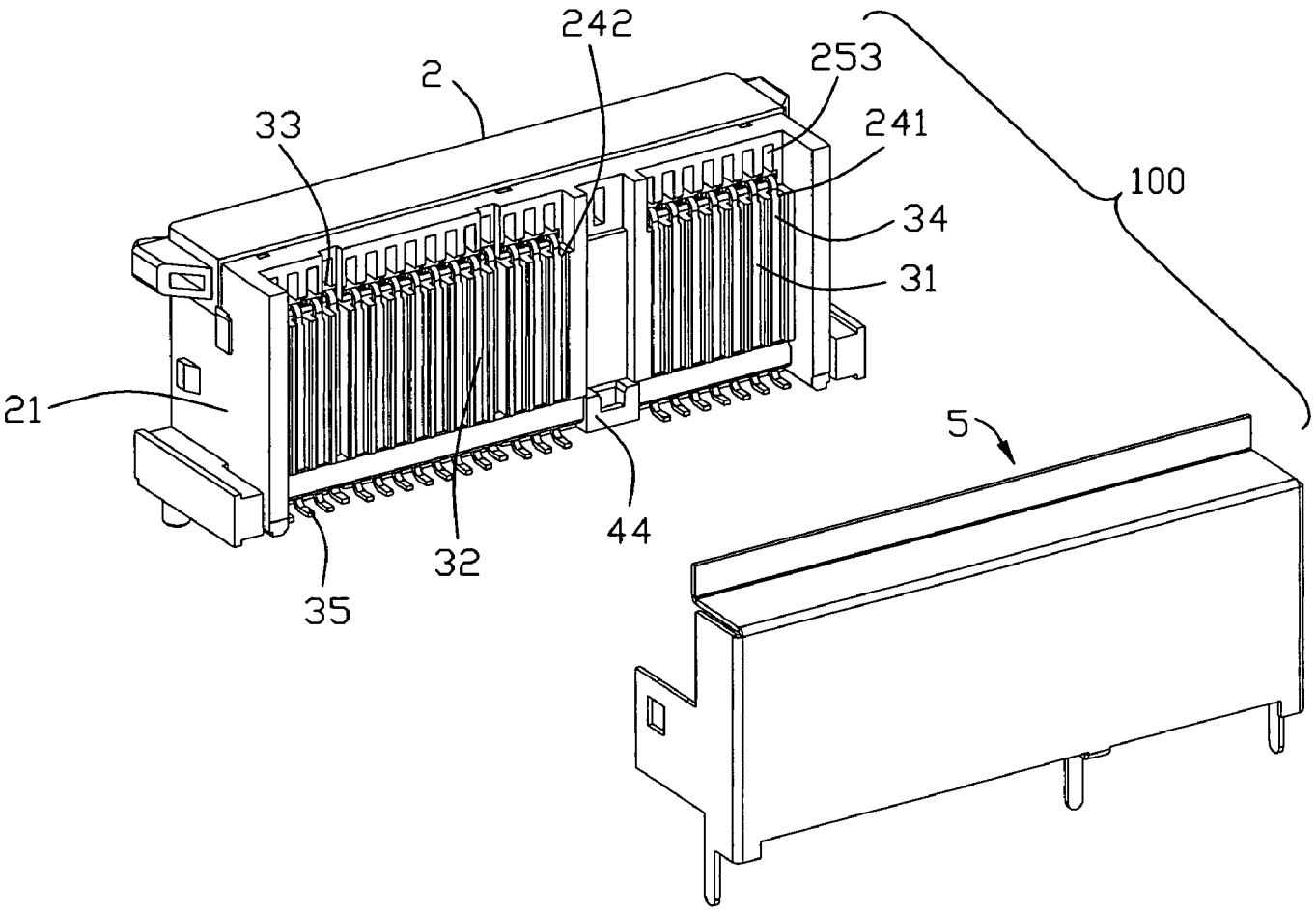
FIG. 5 is a partially assembled view of FIG. 2.
Figure 6:
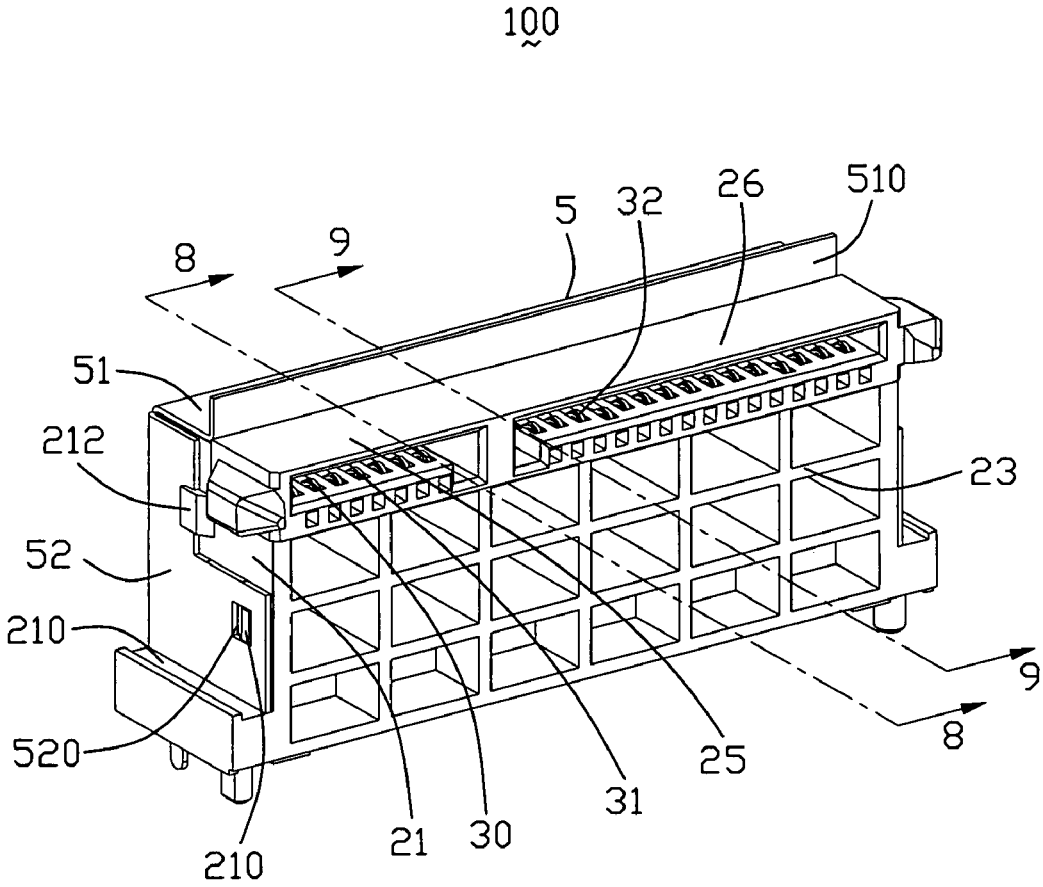
FIGS. 6-7 are assembled, perspective view of FIGS. 1-2.
Figure 7:
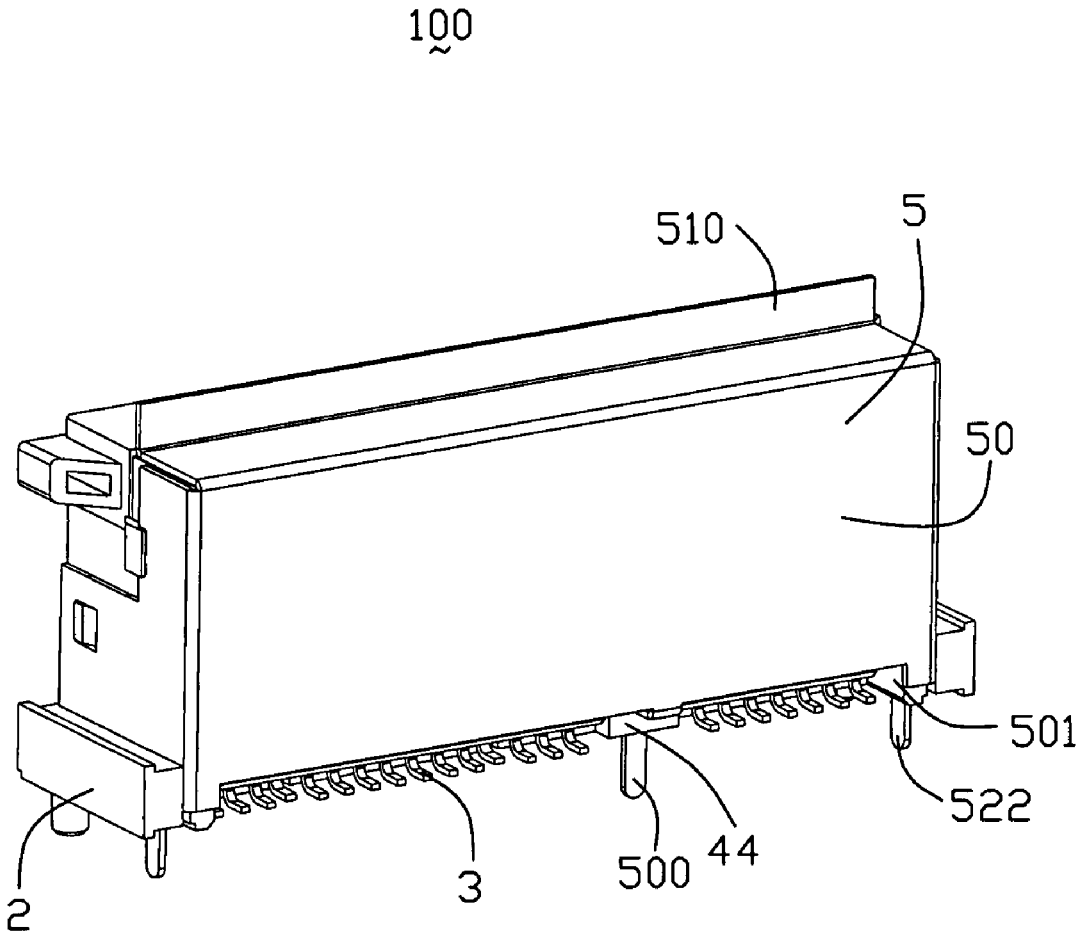
Figure 8:
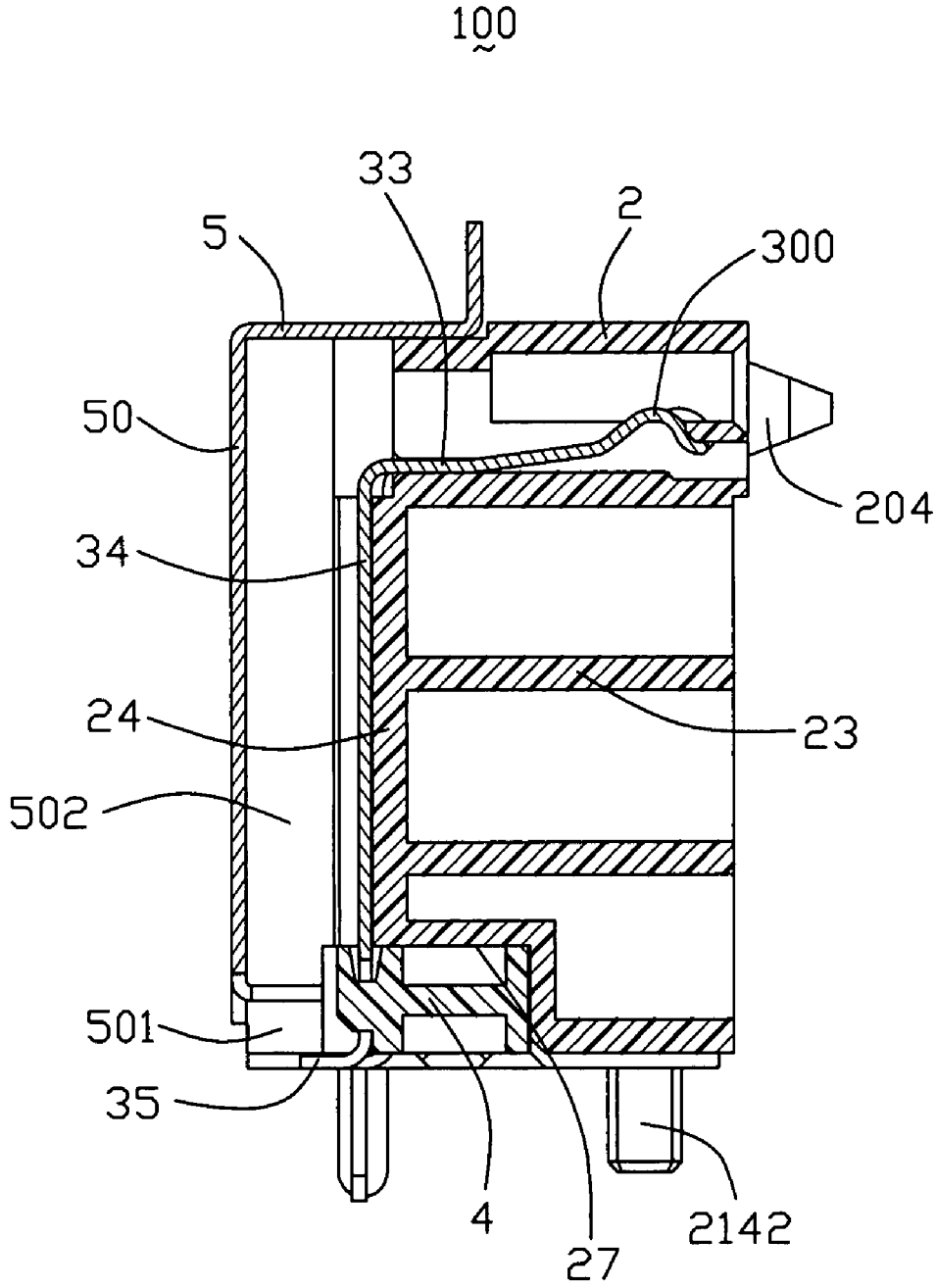
FIGS. 8-9 are cross-section views of the electrical connector taken along lines 8-8 and 9-9 of FIG. 6.
Figure 9:
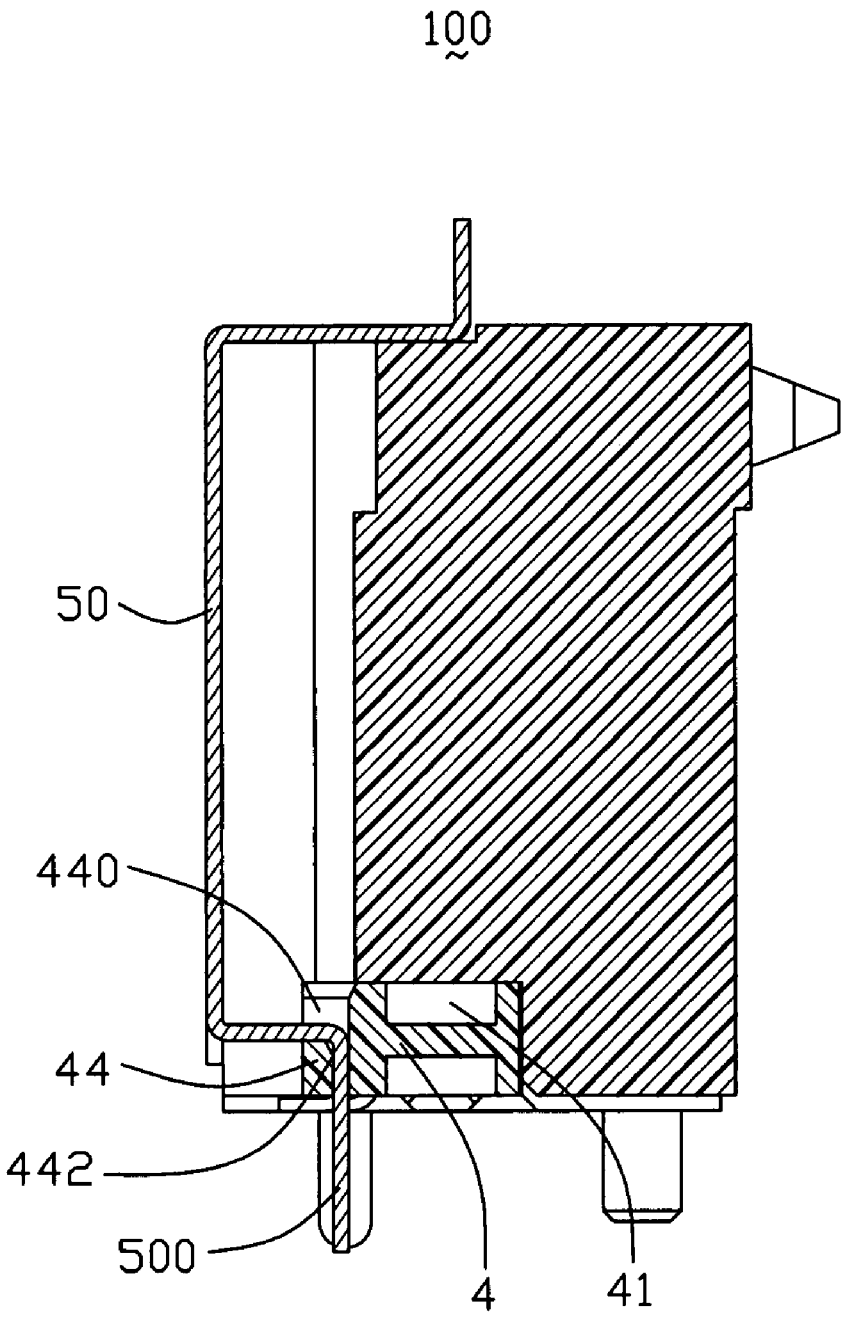

The contacts 3 consist of a set of seven first contacts 31 and a set of fifteen second contacts 32 parallel arranged and having the same structure. Particularly referring to FIG. 4, each contact 3 comprises a curved contacting portion 30 formed with an enhancing rib 300 thereon, a flat media portion 33 formed with a plurality of retention barbs 330 on opposite sides of rear portion thereof, a leg portion 34 bending downwardly from the rear edge of the media portion 33 with main section thereof being enlarged for impedance match. A flat solder tail 35 bends rearwardly from the leg portion 34 for being soldered to the PCB. In addition, the seven first contacts 31 are used for signal transmission and comprise two pairs of differential pairs for signal transmission and three grounding contacts interlaced with the differential pairs to provide ground function to the signal transmission. The fifteen second contacts 32 are for power transmission and comprise five sets for three kinds of voltage transmission, 3.3 v, 5 v and 12 v, and two sets for ground function. Further, Two of the second contacts 32 locate closer to the front surface of the insulative housing 2 than other contacts 3 for safe signal transmission. Thus, the leg portions 34 of the two second contacts 32 locate in front of other leg portions 34.

The spacer 4 is made from insulative material and is elongated. The spacer 4 comprises a rectangular body portion 40. The body portion 40 defines a row of rectangular openings 41 penetrating the body portion 40 along up-to-down direction and in a front section of the body portion 40 and a row of aligning slots 42 behind the row of openings 41 and is divided into two segments corresponding to the leg portions 34 of the contacts 3. Correspondingly, two of the aligning slots 42 locate in front of other aligning slots 42. A pair of recesses 43 are recessed inwardly from opposite side surfaces of the body portion 40 and each recess 40 forms a latch 430 on lower portion thereof. A rectangular protrusion 44 is formed between the two segments of the aligning slots 42 with a notch 440 communicating with upper and rear surfaces of the body portion 40 and a slit 442 downwardly extending therethrough to communicate with the notch 440.

The conductive shell 5 comprises an L-shape top wall 51, a pair of L-shape lateral walls 52 corresponding to the configuration of the sidewalls 21, and a back wall 50 connecting with the top wall 51 and the pair of lateral walls 52. The top wall 51 forms a stopping portion 510 at a forward end thereof and located in a vertical plane. A pair of first solder feet 522 respectively depend downwardly form corresponding lateral walls 52 and adjacent to the back wall 50. A rectangular latching opening 520 is defined in front portion of each lateral wall 52 corresponding to the latch protrusion 210 of the insulative housing 2. The back wall 50 defines a U-shape cutout 501 on lower end thereof. An L-shape second solder foot 500 extending forwardly from lower edge of the cutout 501 of the back wall 50 a certain distance then downwardly extending to align with the pair of first solder feet 522 along the lateral direction. The location of the second solder foot 500 locates closer to the left lateral wall 52 than the right lateral wall 52 corresponding to the division section of the rear wall 24. A pair of barbs 5001 formed on the downwardly-extending portion of the second solder foot 500.

Referring to FIGS. 1-3 and 5-9, in assembly, the first and second contacts 31, 32 are respectively inserted through corresponding first and second receiving passages 253, 263 and interferentially received in the receiving passages 253, 263 via the retention portions 33. The curved contacting portions 30 are partially exposed into the first and second receiving spaces 252, 262. The length of the first and second slots 241, 242 are equal to that of the leg portions 34 of the contacts 3, therefore, the leg portions 34 are pressed into the first and second slots 241, 242 with the tail portions 35 extending beyond the bottom surface of the insulative housing 2. The spacer 4 is assembled to the insulative housing 2 and the tail portions 35 of the contacts 3 along down-to-up direction with the tail portions 35 protruding through the aligning slots 42 and the spacer 4 is received in the opening 27. The pair of blocking portions 270 are received in the recesses 43 of the spacer 4 with the pair of latches 430 received in the wedged-shape cutouts of the blocking portions 270 and the pair of latch hooks 2700 latching with corresponding latches 430. Further, the rectangular protrusion 44 is partially received in lower end of the channel 240 of the insulative housing 2. Thus, the spacer 4 reliably engages with the insulative housing 2. The tail portions 35 of the contacts 3 exposed beyond the spacer 4 are bent outwardly for being soldered to the PCB. After the spacer 4 is assembled to the insulative housing 2, the rear surface of the spacer 4 is substantially coplanar to that of the rear wall 24.

Then, the conductive shell 5 is assembled to the insulative housing 2. The top wall 51, the pair of lateral walls 52, and the back wall 50 cover the insulative housing 2 except the mating port 20 and the front surface of the insulative housing 2 to provide grounding function to the signal and power transmission. The lower edges of the pair of lateral walls 50 are put on the step 214 and closely attach to the sidewalls 21 and the pair of first solder feet 522 protrude through the slits 2140 for being assembled to the PCB together with the supporting posts 2142. The back wall 50 abuts against rear edges of the pair of sidewalls 21 of the insulative housing 2 and forms an interspace 502 together with the rear wall 24 and the pair of sidewalls 21 with the rear wall 24, the leg portions 34 of the contacts 3 and the spacer 4 exposed in the interspace 502 and the tail portions 35 of the contacts 3 exposed outside from the cutout 501 of the back wall 50. The pair of latching openings 520 receives the pair of latch protrusions 210 and the front edges of the lateral walls 52 are clamped by the clamp wedges 212 to enhance the assembly between the conductive shell 5 and the insulative housing 2. The horizontal portion of the second solder foot 500 is received in the notch 440 of the protrusion 44 with the vertical portion thereof protruding through the slit 442 and the barbs 5001 engaging with inner walls of the slit 442 for retaining the second solder foot 500 with the spacer 4. In addition, the stopping portion 510 is located behind the mating port 20 of the insulative housing 2 for indicating the final position of the insertion of the complementary connector. Thus, the second solder foot 500 is located in the channel 240 aligning with the partition wall 205 to further locate between the first and second contacts 31, 32.

In the preferred embodiment of the present invention, the increased width of the leg portions 34 and the dielectric constant of the first and second slots 241, 242 are both helpful to the impedance matching, that is to say, to adjust the impedance of the contacts 3 to desirable value. The position of the second solder foot 500 decreases the area of the cutout 501 to decrease the leakage of EMI.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for mating with a complementary connector along a mating direction, comprising:

an insulative housing comprising a front mating port extending along said mating direction, a rear wall extending downwardly from the front mating port, and a front wall opposite to the rear wall, the front mating port defining a plurality of receiving passages along said mating direction, the rear wall being slotted with a plurality of slots extending along an up-to-down direction perpendicular to said mating direction;

a plurality of contacts received in the receiving passages and the slots of the insulative housing, each contact comprising a curved mating portion received in corresponding receiving passage and partially exposed beyond the receiving passage, a retention portion interferentially engaged with the receiving passage to retain the contact in the insulative housing, a leg portion bending downwardly from the retention portion to be mainly received in each of the slots of the insulative housing, and a tail portion formed at a lower end of the leg portion and bending horizontally from the lower end of the leg portion; wherein the leg portion has a larger width than other portion thereof and is completely received in corresponding slot to achieve a certain dielectric constant for signal transmission;

and a conductive shell enclosing the insulative housing and the contacts except the mating port and contacting portions of the contacts; and wherein the conductive shell comprises a first solder foot formed on a rear wall and a pair of lateral walls covering a pair of sidewalls of the insulative housing, wherein each lateral wall forms a second solder foot extending downwardly therefrom to align with the first solder foot in a row along a lateral direction; and a spacer assembled to the contacts and the insulative housing, wherein the spacer defines a protrusion with a slit therethrough, the first solder foot is assembled to the spacer via protruding through the slit.

2. The electrical connector as claimed in claim 1, wherein the insulative housing is of right angle shape and comprises a first mating segment and a second mating segment side by side arranged along the lateral direction perpendicular to said mating direction and divided by a partition wall, the slots of the rear wall are also divided into two groups by a dividing section.

3. The electrical connector as claimed in claim 2, wherein the contacts comprise a plurality of first contacts accommodated in the first mating segment and one group of the slots for signal transmission and a plurality of second contacts accommodated in the second mating segment and the other group of the slots for power transmission.

4. The electrical connector as claimed in claim 2, wherein the insulative housing further comprises the pair of sidewalls extending downwardly from opposite sides of the mating port, and wherein the rear wall is formed between the pair of sidewalls with a certain distance to rear edges of the sidewalls.

5. The electrical connector as claimed in claim 4, a plurality of strengthened stiffeners are formed among the pair of sidewalls and the front wall in a crisscross fashion.

6. The electrical connector as claimed in claim 4, further comprising the spacer defining a row of aligning slots to align the leg portions of the first and second contacts and assembled between the pair of sidewalls and below the rear wall.

7. The electrical connector as claimed in claim 6, wherein the spacer defines a pair of recesses inwardly from opposite sides thereof, each recess forms a latch thereon, and wherein the housing forms a pair of blocking portions on sidewalls to latch with the pair of latches of the spacer.

8. The electrical connector as claimed in claim 2, wherein each of the first and second mating segments define an L-shape receiving space with the mating portions of the contacts partially exposed in the receiving spaces.

9. An electrical connector adapted for mating with a complementary connector along a mating direction, comprising:

an insulative housing comprising first and second mating segments side by side arranged along a lateral direction perpendicular to said mating direction and divided by a partition wall, and a rear wall extending downwardly from rear ends of the first and second mating segments and forming a division section to divide the rear wall into two parts corresponding to the first and second mating segments;

a plurality of first and second contacts received in the insulative housing with mating portions thereof received in the first and second mating segments, and leg portions bending downwardly to be located in the two parts of the rear wall;

a conductive shell enclosing the insulative housing and the contacts except the first and second mating segments and mating portions of the contacts; and wherein the conductive shell forms a first solder foot aligning with the division section of the rear wall of the insulative housing for being assembled to a printed circuit board; and a spacer assembled to the contacts and the insulative housing and located below the rear wall, the spacer defines a protrusion aligning with the division section, and the protrusion has a slit therethrough, the first solder foot is assembled to the spacer via protruding through the slit; wherein the conductive shell comprises a pair of lateral walls covering a pair of sidewalls of the insulative housing, wherein each lateral wall forms a second solder foot extending downwardly therefrom to align with the first solder foot in a row along the lateral direction.

10. The electrical connector as claimed in claim 9, wherein the conductive shell comprises a rear wall defines a cutout at lower end thereof with tail portions of the contacts can be viewed from the cutout, and wherein the first solder foot is formed with lower edge of the cutout.

11. The electrical connector as claimed in claim 10, wherein the first solder foot of the conductive shell is of L-shape and comprises a horizontal section extending forwardly from lower edge of the cutout and a vertical section downwardly from the horizontal section.

12. The electrical connector as claimed in claim 9, wherein the insulative housing comprises the pair of sidewalls formed at opposite sides of the mating segments and extends beyond the rear wall, and wherein the back wall of the conductive shell abuts against rear edges of the sidewalls to form an interspace together with the sidewalls and the rear wall of the insulative housing with the leg portions of the contacts exposed in the interspace.

13. An electrical connector comprising:

an insulative housing;

a mating port formed on the housing;

a plurality of passageways formed in the housing and communicating with the mating port;

a plurality of contacts disposed in the housing, each of said contacts defining a vertical retention section and a right angle tail below said vertical retention section for surface mounting on a corresponding printed circuit board on which the housing is seated;

a tail spacer assembled to the housing and defining a plurality of holes therethrough in a vertical direction;

a metallic shell having top plate, two side plates respectively covering a top face and two side faces of the housing, and further having a rear plate covering the rear face; and the tail of each of the contacts extending through the corresponding hole with a horizontal section of the tail extending rearwardly beyond a rear edge of said tail spacer while terminated before reaching the rear plate; wherein a bottom edge region of said rear plate of the shell is removed to expose the horizontal sections of the tails for inspection; wherein solder feet formed on the two side plates of the shell are aligned with another older foot formed on the rear plate in a row along a lateral direction; and wherein the spacer forms a protrusion aligned with a division of the mating port in a vertical direction and defining a slit therethrough in said vertical direction, and said solder foot of the rear plate extends through said slit in said vertical direction.

14. The electrical connector as claimed in claim 13, wherein a plurality of ribs are formed on a rear face of the housing so as to form a plurality of channels each formed between every adjacent two ribs and aligned with the corresponding passageway.

15. The electrical connector as claimed in claim 14, wherein the vertical section of each of said contacts is snugly received in the corresponding channel.

* * * * *